US009478087B2

(12) United States Patent
Proefke et al.

(10) Patent No.: US 9,478,087 B2
(45) Date of Patent: Oct. 25, 2016

(54) METHODS AND SYSTEMS FOR COMMUNICATING BETWEEN A VEHICLE AND A REMOTE DEVICE

(71) Applicant: GM GLOBAL TECHNOLOGY OPERATIONS LLC, Detroit, MI (US)

(72) Inventors: David T. Proefke, Troy, MI (US); Aaron P. Creguer, Fenton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 398 days.

(21) Appl. No.: 14/026,989

(22) Filed: Sep. 13, 2013

(65) Prior Publication Data

US 2015/0077225 A1 Mar. 19, 2015

(51) Int. Cl.
*G07C 9/00* (2006.01)

(52) U.S. Cl.
CPC ..... *G07C 9/00182* (2013.01); *G07C 9/00309* (2013.01); *G07C 2009/0019* (2013.01); *G07C 2009/00357* (2013.01)

(58) Field of Classification Search
CPC ..... G07C 9/00182; G07C 9/00309; G07C 2009/0019; G07C 2009/00357; G07C 2009/00373
USPC ..... 340/5.61, 5.63, 5.72, 426.17, 426.36
See application file for complete search history.

(56) References Cited

U.S. PATENT DOCUMENTS

| | | | | |
|---|---|---|---|---|
| 6,538,560 | B1 * | 3/2003 | Stobbe | B29C 44/56 340/5.72 |
| 2002/0017978 | A1 * | 2/2002 | Kanda | G07C 9/00309 340/5.61 |
| 2010/0245038 | A1 * | 9/2010 | Ghabra | G07C 9/00309 340/5.61 |

* cited by examiner

*Primary Examiner* — Edwin Holloway, III
(74) *Attorney, Agent, or Firm* — Lorenz & Kopf LLP

(57) ABSTRACT

Methods, apparatus and systems are provided for communications between a vehicle and a remote device using a first vehicle communications module that communicates via a first communication channel. One exemplary method involves transmitting, by a second vehicle communications module via a second communication channel, an indication of an operating state of the first communications module, receiving, by the first communications module via the first communication channel, an acknowledgment responsive to the indication from the remote device, and changing the operating state of the first communications module in response to receiving the acknowledgment.

18 Claims, 7 Drawing Sheets

METHODS AND SYSTEMS FOR COMMUNICATING BETWEEN A VEHICLE AND A REMOTE DEVICE

TECHNICAL FIELD

Embodiments of the subject matter described herein generally relate to vehicle systems, and more particularly relate to systems and methods for communicating between a vehicle and a remote device, such as an electronic key fob.

BACKGROUND

In recent years, advances in technology have led to substantial changes in the design of automobiles. For example, electronic key fobs are now ubiquitous and capable of communicating with the vehicle to allow the user to initiate any number of operations, such as, remote starting, remote locking/unlocking, or the like. More recently, automatic operations based on the proximity of a key fob are being incorporated into vehicles. However, these so-called "passive" features typically require the vehicle to continually monitor the surrounding environment for the presence of the key fob, which, in turn, continually consumes power from the battery or another energy source within the vehicle. Multiple communication modules may be co-located and integrated within a single vehicle component to reduce the energy consumption of the passive features. However, such integration often results in undesirable component sizes, decreased component packaging flexibility due to the transmission path characteristics of the communication frequencies utilized, and potentially increased costs. Accordingly, it is desirable to provide systems and methods for detecting the presence of the key fob with reduced power consumption without compromising the integration and packaging flexibility of the communication modules. Other desirable features and characteristics will become apparent from the subsequent detailed description and the appended claims, taken in conjunction with the accompanying drawings and the foregoing technical field and background.

SUMMARY

In one of various exemplary embodiments, a method is provided for operating a first vehicle communications module that communicates with a remote device via a first communication channel. The method involves transmitting, by a second vehicle communications module via a second communication channel, an indication of an operating state of the first communications module, receiving, by the first communications module via the first communication channel, an acknowledgment responsive to the indication from the remote device, and changing the operating state of the first communications module in response to receiving the acknowledgment.

In another embodiment, an apparatus for a vehicle is provided. The vehicle includes a first communications module configured to communicate via a first communication channel and a second communications module configured to transmit an indication of a first operating state of the first communications module via a second communication channel. The first communications module is configured to transition from the first operating state to a second operating state in response to receiving an acknowledgment responsive to the indication from a remote device via the first communication channel.

According to another of various exemplary embodiments, an apparatus for a remote device suitable for use with an automotive vehicle is also provided. The remote device includes a first communications module configured to receive, via a first communication channel, an indication of an operating state of a vehicle communications module communicating via a second communication channel, and a second communications module configured to transmit a response to the indication via the second communication channel, wherein a duration of the response is influenced by the operating state of the vehicle communications module.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
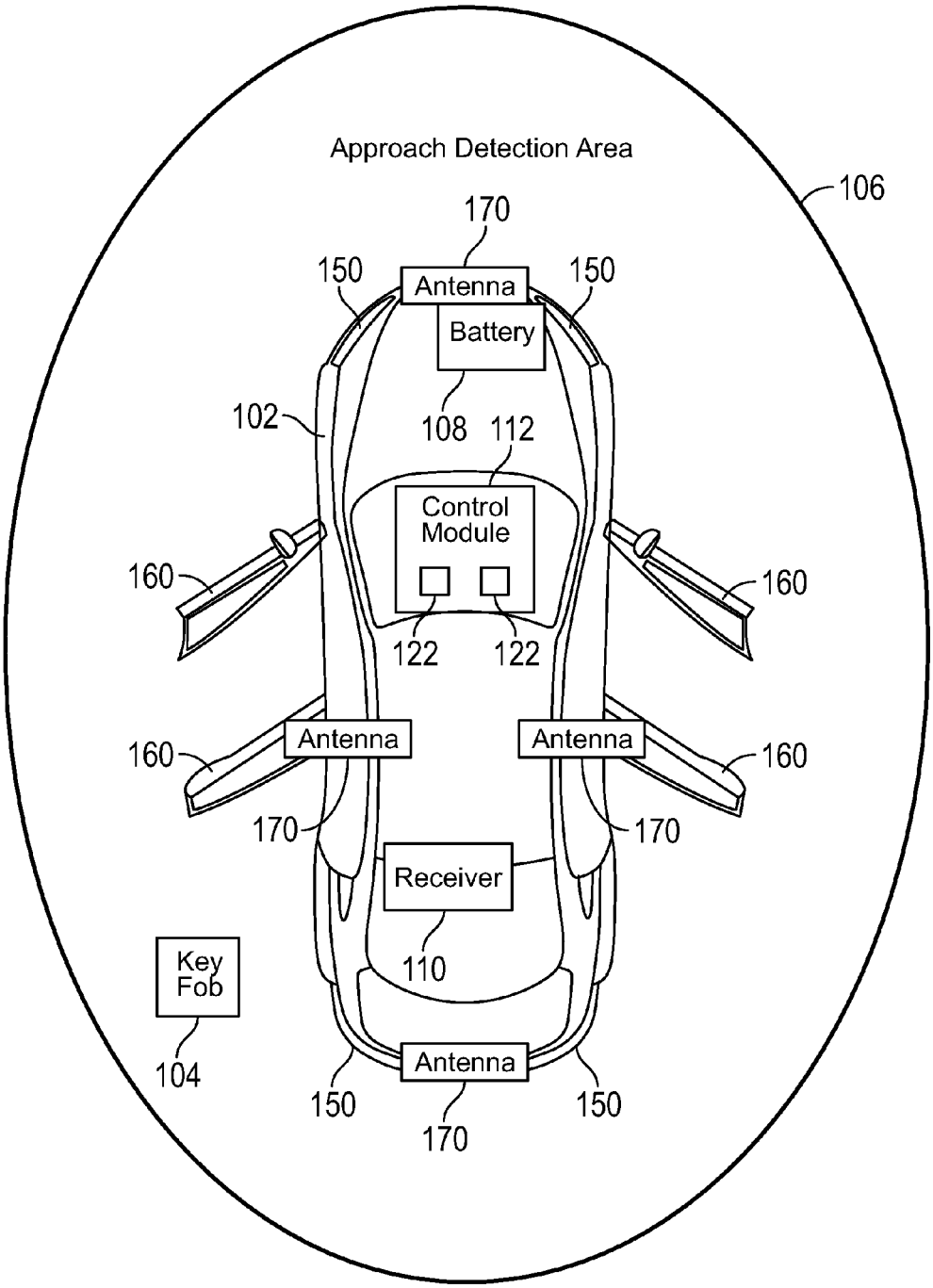
FIG. 1 is a block diagram of an exemplary communications system suitable for use with a vehicle in accordance with an embodiment.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Embodiments of the subject matter described herein relate to communications between a vehicle, such as an automobile, and a remote device associated with the vehicle, such as an electronic key fob. In exemplary embodiments, the vehicle includes a first communications module configured to communicate via a first communication channel and a second communications module configured to communicate via a second communication channel. For example, in one embodiment, the first communications module communicates via ultra-high frequency (UHF) communication channel and the second communications module communicates via a low frequency (LF) communication channel. Similarly, the remote device includes a communications module capable of communicating with the vehicle via a higher frequency (e.g., UHF) communication channel and a second communications module capable of communicating with the vehicle the lower frequency (e.g., LF) communication channel.

In exemplary embodiments, the vehicle higher frequency communications module operates in a lower power operating state (e.g., a sleep mode, an idle mode, or another low power operating mode) when the remote device is not within communications range of the vehicle. The vehicle lower frequency communications module periodically transmits an indication of the lower power operating state via the lower frequency communication channel. When the remote device is within the communications range of the vehicle, the remote device receives the indication of the lower power operating state and automatically transmits a response (or acknowledgment) via the higher frequency communication channel that has a duration that is influenced by the identified lower power operating state of the vehicle higher frequency communications module. The vehicle higher frequency communications module receives or otherwise detects the response and automatically transitions or otherwise changes from the lower power operating state to a higher power operating state (e.g., an active mode) to receive the entire content of the response. Thereafter, the content of the response is parsed or otherwise analyzed to authenticate that the source of the received response is the remote device that is associated or otherwise paired with the vehicle. In response to authenticating the remote device, operation of one or more vehicle subsystems may be automatically initiated to effectuate one or more "passive" features, such as, for example, passive lighting, passive/keyless entry, or the like.

Turning now to FIG. 1, an exemplary communications system 100 includes a vehicle 102 capable of communicating with a remote device 104 via a plurality of communication channels when the remote device 104 is within a communications range 106 associated with one or more communications modules 110, 120 of the vehicle 102. In this regard, the vehicle 102 includes at least a first communication module 110 configured to communicate via a first communication channel and a second communication module 120 configured to communicate via a second communication channel that is different from the first communication channel utilized by the first communication module 110. It should be understood that FIG. 1 is a simplified representation of a communications system 100 for purposes of explanation and is not intended to limit the scope or applicability of the subject matter described herein in any way.

Still referring to FIG. 1, in exemplary embodiments, the first communication module 110 communicates over the first communication channel within a higher frequency range than the frequency range over which the second communication module 120 communicates. For example, in one embodiment, the first communication module 110 operates within the ultra-high frequency (UHF) range such that the frequency of the first communication channel is in the range of about 300 MHz to about 3 GHz while the second communication module 120 operates within the low frequency (LF) range such that the frequency of the second communication channel is in the range of about 20 kHz to about 300 kHz. For purposes of explanation, the first communication module 110 may alternatively be referred to herein as the higher frequency communications module and the second communication module 120 may alternatively be referred to herein as the lower frequency communications module.

In exemplary embodiments, the vehicle 102 is realized as an automobile, and depending on the embodiment, the vehicle 102 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD), or all-wheel drive (AWD). The vehicle 102 may also incorporate any one of, or combination of, a number of different types of engines, such as, for example, a gasoline or diesel fueled combustion engine, a "flex fuel vehicle" (FFV) engine (i.e., using a mixture of gasoline and alcohol), a gaseous compound (e.g., hydrogen and natural gas) fueled engine, a combustion/electric motor hybrid engine, and an electric motor. In alternative embodiments, the vehicle 102 may be a plug-in hybrid vehicle, a fully electric vehicle, a fuel cell vehicle (FCV), or another suitable alternative fuel vehicle. The energy source 108 (or power source) generally represents the component of the vehicle 102 that is capable of providing a direct current (DC) voltage (or current) for operating other components of the vehicle 102. For example, depending on the embodiment, the energy source 108 may be realized as a battery, a fuel cell, a rechargeable high-voltage battery pack, an ultracapacitor, or another suitable energy source known in the art. As illustrated in FIG. 1, in some embodiments, the energy source 108 may reside in a front (or forward) portion of the vehicle 102.

As described in greater detail below, in exemplary embodiments, when the remote device 104 is outside the communications range 106 of the higher frequency communications module 110, the higher frequency communications module 110 is operated in an idle mode, a sleep mode, a low power mode, or the like to reduce the amount of power and/or current that is consumed by the higher frequency communications module 110 from an energy source 108 in the vehicle 102. In a lower power state, the vehicle higher frequency communications module 110 may periodically consume power and/or current from the energy source 108 for a relatively small percentage of a polling period. In one embodiment, the vehicle higher frequency communications module 110 periodically consumes power and/or current from the energy source 108 for less than ten percent of a polling period. For example, the polling period may be thirty milliseconds, where the vehicle higher frequency communications module 110 periodically consumes power and/or current for about three milliseconds.

While the higher frequency communications module 110 is in a lower power state, the lower frequency communications module 120 periodically broadcasts or otherwise transmits a query to determine which, if any, remote devices are present in proximity to the vehicle. Included within the query signal is an indication that the vehicle higher frequency communications module 110 is in the lower power state. When the remote device 104 is within the communications range of the lower frequency communications module 120, the remote device 104 receives the indication of the lower power state for the vehicle higher frequency communications module 110, and in response, automatically broadcasts or otherwise transmits a response or acknowledgment that is configured to change the operating state of the vehicle higher frequency communications module 110. The vehicle higher frequency communications module 110 receives the response and automatically transitions from the lower power state to a higher power state to support communications to/from the remote device 104 while the remote device 104 is within the communications range 106 of the vehicle higher frequency communications module 110. In some embodiments, the vehicle higher frequency communications module 110 continuously consumes power and/or current from the energy source 108 in the higher power state.

Figure 2:
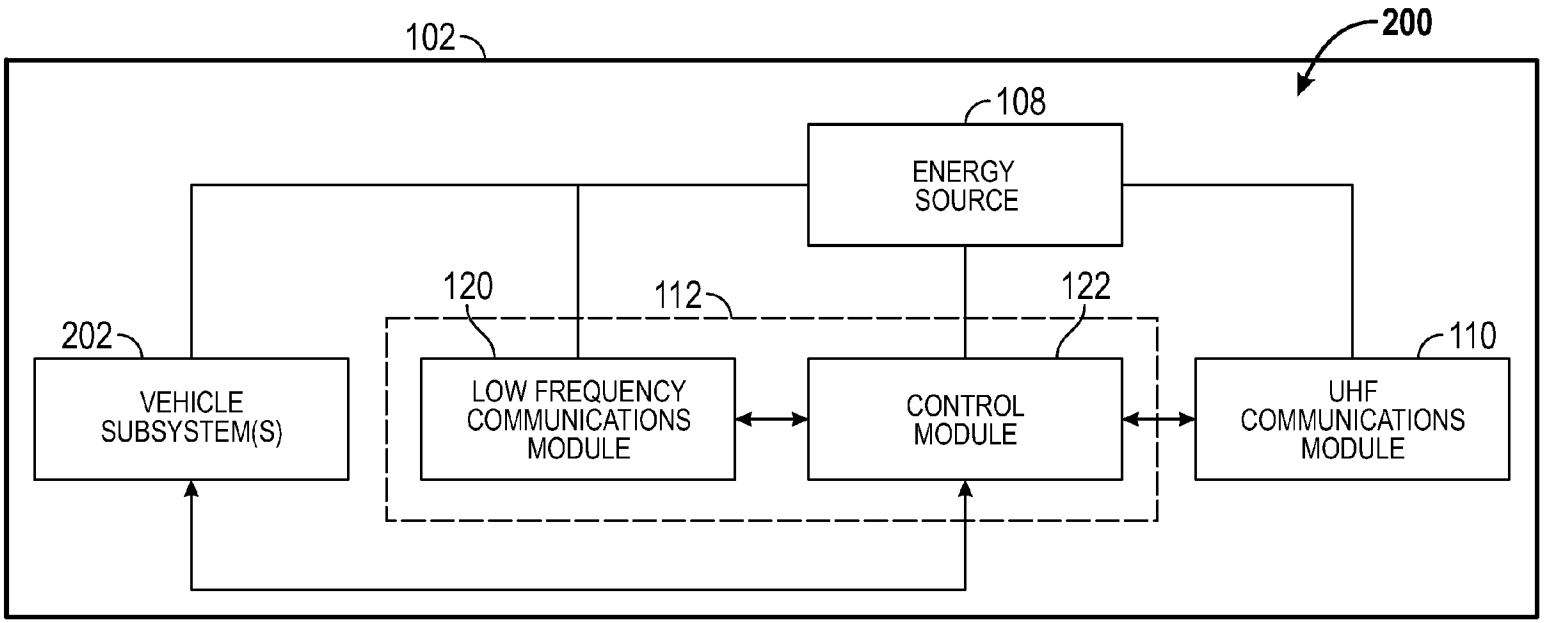
FIG. 2 is a block diagram of an exemplary vehicle electrical system suitable for use with the vehicle in the communications system of FIG. 1 in accordance with an embodiment.

Referring now to FIG. 2, and with continued reference to FIG. 1, in exemplary embodiments, the vehicle 102 includes a control module 122 that is coupled to the communications modules 110, 120 to monitor or otherwise identify the current operating state of the vehicle higher frequency communications module 110 and receive, from the vehicle higher frequency communications module 110, the acknowledgment transmitted by the remote device 104 in response to the indication of the state of the vehicle higher frequency communications module 110 that was transmitted by the vehicle lower frequency communications module 120. In accordance with one or more embodiments, the control module 122 utilizes the acknowledgment received via the vehicle higher frequency communications module 110 to authenticate the source of the acknowledgment as being the remote device 104 that was previously paired or otherwise associated with the vehicle 102. In response to authenticating the remote device 104, the control module 122 may automatically initiate operation of one or more subsystems 202 of the vehicle 102 (e.g., a lighting system, an entry system, an ignition system, or the like) in response to detecting the presence of a paired remote device 104 within a vicinity of the vehicle 102. For example, a lighting system 202 may be operated to automatically turn on the headlights and/or taillights 150 of the vehicle 102, an entry system 202 may be operated to automatically unlock and/or open one or more doors 160 of the vehicle 102, an ignition system 202 may be operated to automatically start a motor of the vehicle 102, or the like. It should be understood that FIG. 2 is a simplified representation of a vehicle electrical system 200 for purposes of explanation and is not intended to limit the scope or applicability of the subject matter described herein in any way.

Still referring to FIGS. 1-2, the control module 122 generally represents the hardware, processing logic, circuitry and/or a combination thereof that is coupled to the communications modules 110, 120 and configured to support detecting the presence of the remote device 104 within a vicinity of the vehicle 102. Depending on the embodiment, the control module 122 may be implemented or realized with a general purpose processor, a microprocessor, a controller, a microcontroller, a state machine, a content addressable memory, an application specific integrated circuit, a field programmable gate array, any suitable programmable logic device, discrete gate or transistor logic, discrete hardware components, or any combination thereof, designed to perform the functions described herein. Furthermore, the steps of a method or algorithm described in connection with the embodiments described herein may be embodied directly in hardware, in firmware, in a software module executed by the control module 122, or in any practical combination thereof. In exemplary embodiments, the control module 122 includes or otherwise accesses a data storage element or memory, including any sort of random access memory (RAM), read only memory (ROM), flash memory, registers, hard disks, removable disks, magnetic or optical mass storage, or any other short or long term storage media or other non-transitory computer-readable medium, which is capable of storing programming instructions for execution by the control module 122. The computer-executable programming instructions, when read and executed by the control module 122, cause the control module 122 to perform various tasks, operations, functions, and processes described herein. Additionally, the data storage element stores or otherwise maintains a unique identifier associated with the remote device 104 (e.g., an identification number or the like), thereby maintaining a pairing or association between the remote device 104 and the vehicle 102. The data storage element may also store or otherwise maintain a unique identifier associated with the vehicle 102 that may be utilized to wake, enable, or otherwise activate the remote device 104, as described below.

In exemplary embodiments, the vehicle lower frequency communications module 120 is realized as a transceiver or another suitable combination of baseband processing modules, radio frequency processing modules, multiplexers, mixers, modulators and/or demodulators, amplifiers, drivers, or the like, that is configured to support transmitting and receiving electromagnetic signals within a relatively lower frequency range (e.g., LF signals) via one or more antennas 170 in the vehicle 102. In the illustrated embodiments of FIGS. 1-2, the vehicle lower frequency communications module 120 and the control module 122 are packaged or otherwise integrated together to provide a detection module 112 within the vehicle 102. For example, the vehicle lower frequency communications module 120 and the control module 122 may be mounted to a common substrate (e.g., a circuit board, a lead frame, or the like) and encapsulated in an appropriate manner to provide a packaged device. In accordance with one or more embodiments, the detection module 112 is disposed or otherwise packaged within the front (or forward) portion of the vehicle 102, as illustrated in FIG. 1. For example, the detection module 112 may be packaged in a dashboard portion of the vehicle 102 underneath or behind an instrument panel. That said, it should be appreciated that the subject matter described herein is not limited to any particular location of the detection module 112 within the vehicle 102. As illustrated in FIG. 1, the antennas 170 may be disposed distal to the detection module 112, for example, at the side and/or end portions of the vehicle 102, with the antennas 170 being coupled to the vehicle lower frequency communications module 120 via wiring within the vehicle 102.

Still referring to FIGS. 1-2, in exemplary embodiments, the vehicle higher frequency communications module 110 is realized as a transceiver or another suitable combination of baseband processing modules, radio frequency processing modules, multiplexers, mixers, modulators and/or demodulators, amplifiers, drivers, or the like, that is configured to support transmitting and receiving electromagnetic signals within a relatively higher frequency range (e.g., UHF signals) than the lower frequency communications module 120. In exemplary embodiments, the vehicle higher frequency communications module 110 also includes one or more antennas integrated therewith, wherein the one or more antennas are configured to transmit/receive electromagnetic signals in the higher frequency range supported by the higher frequency communications module 110 (e.g., UHF). In some alternative embodiments, the antenna(s) for the vehicle higher frequency communications module 110 may be external to the vehicle higher frequency communications module 110 and communicatively coupled to the vehicle higher frequency communications module 110 and/or its internal components in a known manner.

In the illustrated embodiments of FIGS. 1-2, the vehicle higher frequency communications module 110 is packaged separately from the detection module 112 so that the vehicle higher frequency communications module 110 may be packaged or otherwise positioned within the vehicle 102 independently of the detection module 112 and/or the antennas 170. For example, as illustrated in FIG. 1, the vehicle higher frequency communications module 110 may be packaged, mounted, or otherwise disposed in a rear portion of the vehicle 102 and away from electrical components that may be packaged underneath and/or in the dashboard and/or instrument panel (e.g., liquid crystal displays (LCDs) and related drivers, navigation systems, entertainment systems, or the like) and/or other components in a forward portion of the vehicle 102 (e.g., electrical converters, electric motors, or the like) that could otherwise generate electromagnetic interference that could interfere with the ability of the vehicle higher frequency communications module 110 to accurately receive higher frequency signals from the remote device 104.

Figure 3:
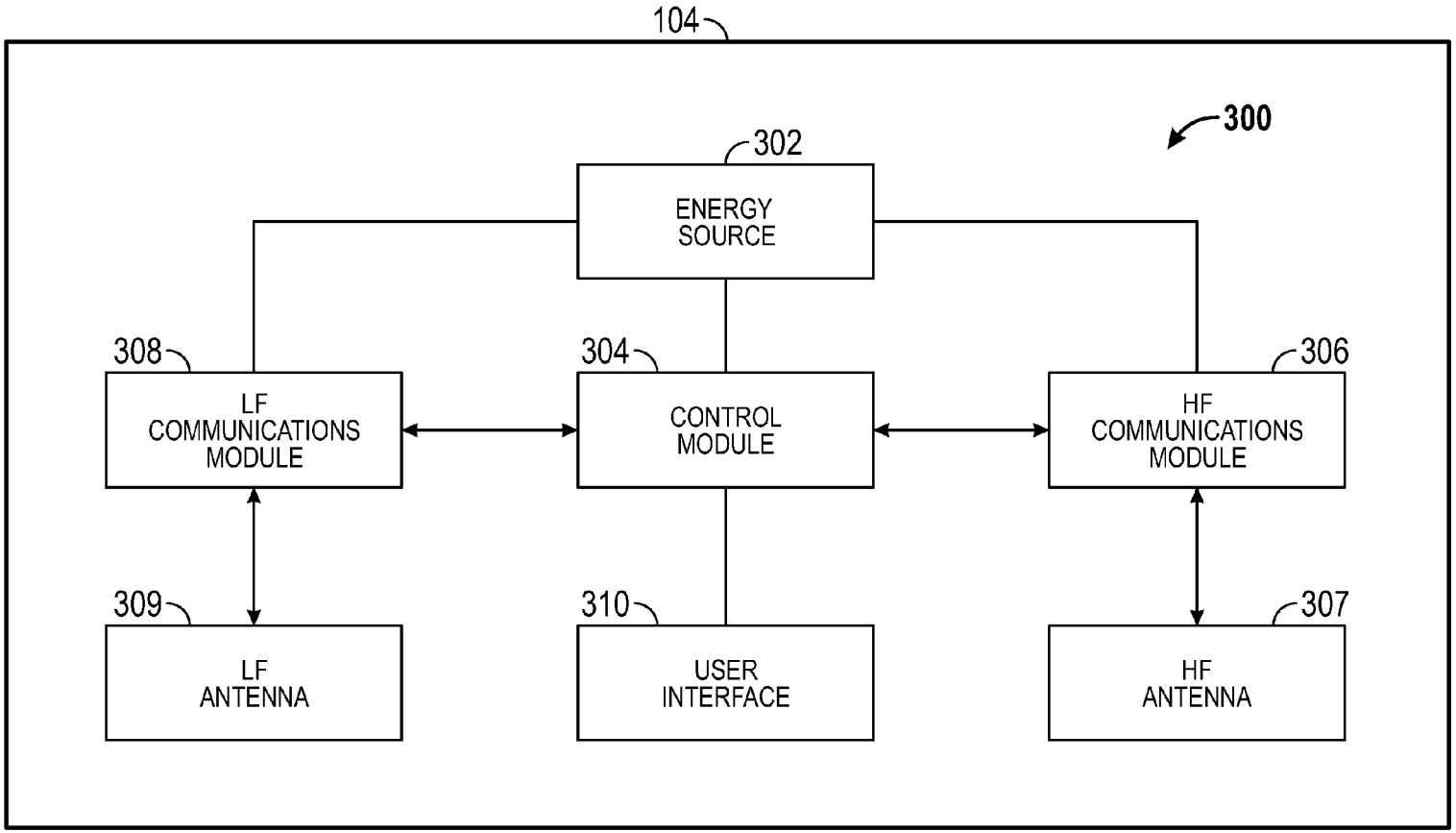
FIG. 3 is a block diagram of an exemplary remote device suitable for use in the communications system of FIG. 1 in accordance with an embodiment.

Referring now to FIG. 3, and with continued reference to FIGS. 1-2, in exemplary embodiments, the remote device 104 includes, without limitation, an energy source 302, a control module 304, a first communications module 306 coupled to a first antenna 307, a second communications module 308 coupled to a second antenna 309, and one or more user input elements 310. In exemplary embodiments, the first communications module 306 is configured to communicate over a communication channel within a higher frequency range (e.g., with vehicle higher frequency communications module 110 in the vehicle 102) than the frequency range over which the second communications module 308 communicates. For example, in one embodiment, the first communication module 306 operates within the ultra-high frequency (UHF) range corresponding to the vehicle higher frequency communications module 110 and the second communication module 308 operates within the low frequency (LF) range corresponding to the vehicle lower frequency communications module 120. Accordingly, for purposes of explanation, the first communications module 306 may alternatively be referred to herein as the higher frequency communications module and the second communications module 308 may alternatively be referred to herein as the lower frequency communications module. It should be understood that FIG. 3 is a simplified representation of an electrical system 300 suitable for use within the remote device 104 provided for purposes of explanation and is not intended to limit the scope or applicability of the subject matter described herein in any way.

In exemplary embodiments, the remote device 104 is realized as an electronic key fob, however, the subject matter described herein is not limited to any particular type of remote device 104. In alternative embodiments, the remote device 104 may be realized as any sort of electronic device capable of communicating with the vehicle communications modules 110, 120, such as a mobile or cellular telephone, a laptop or notebook computer, a tablet computer, a desktop computer, a personal digital assistant, or the like. In yet other alternative embodiments, the remote device 104 could be realized as a garment, a piece of jewelry, or any other item that includes electronics capable of supporting the subject matter described herein. That said, electronic key fobs are commonly used to interact with vehicles, and accordingly, for purposes of explanation, but without limitation, the remote device 104 may alternatively be referred to herein as a key fob (or simply fob).

The energy source 302 generally represents the component of the key fob 104 that is coupled to the various modules 304, 306, 308 to provide a direct current (DC) voltage (or current) for operating the various modules 304, 306, 308 of the key fob 104. For example, in one or more embodiments, the energy source 302 is realized as a coin cell battery.

The control module 304 generally represents the hardware, processing logic, circuitry and/or a combination thereof that is coupled to the fob communications modules 306, 308 and configured to support communications with the vehicle 102 when the key fob 104 is within a vicinity of the vehicle 102. Depending on the embodiment, the control module 304 may be implemented or realized with a general purpose processor, a microprocessor, a controller, a microcontroller, a state machine, a content addressable memory, an application specific integrated circuit, a field programmable gate array, any suitable programmable logic device, discrete gate or transistor logic, discrete hardware components, or any combination thereof, designed to perform the functions described herein. Furthermore, the steps of a method or algorithm described in connection with the embodiments described herein may be embodied directly in hardware, in firmware, in a software module executed by the control module 304, or in any practical combination thereof. In exemplary embodiments, the control module 304 includes or otherwise accesses a data storage element or memory, including any sort of random access memory (RAM), read only memory (ROM), flash memory, registers, hard disks, removable disks, magnetic or optical mass storage, or any other short or long term storage media or other non-transitory computer-readable medium, which is capable of storing programming instructions for execution by the control module 304. The computer-executable programming instructions, when read and executed by the control module 304, cause the control module 304 to perform various tasks, operations, functions, and processes described herein. In a similar manner as described above, in exemplary embodiments, the data storage element accessed by or otherwise integrated with the control module 304 stores or otherwise maintains a unique identifier associated with the vehicle 102 (e.g., a vehicle identification number or the like), thereby maintaining a pairing or association with the vehicle 102. The data storage element may also store or otherwise maintain the unique identifier associated with the remote device 104.

In a similar manner as described above in the context of the vehicle higher frequency communications module 110, in exemplary embodiments, the fob higher frequency communications module 306 is realized as a transceiver or another suitable combination of baseband processing modules, radio frequency processing modules, multiplexers, mixers, modulators and/or demodulators, amplifiers, drivers, or the like, that is configured to support transmitting and receiving electromagnetic signals within a relatively higher frequency range (e.g., UHF signals) via a higher frequency antenna 307 within the fob 104. Similarly, the fob lower frequency communications module 308 is realized as a transceiver or another suitable combination of baseband processing modules, radio frequency processing modules, multiplexers, mixers, modulators and/or demodulators, amplifiers, drivers, or the like, that is configured to support transmitting and receiving electromagnetic signals within a relatively lower frequency range (e.g., LF signals) via a lower frequency antenna 309 within the fob 104.

Figure 4:
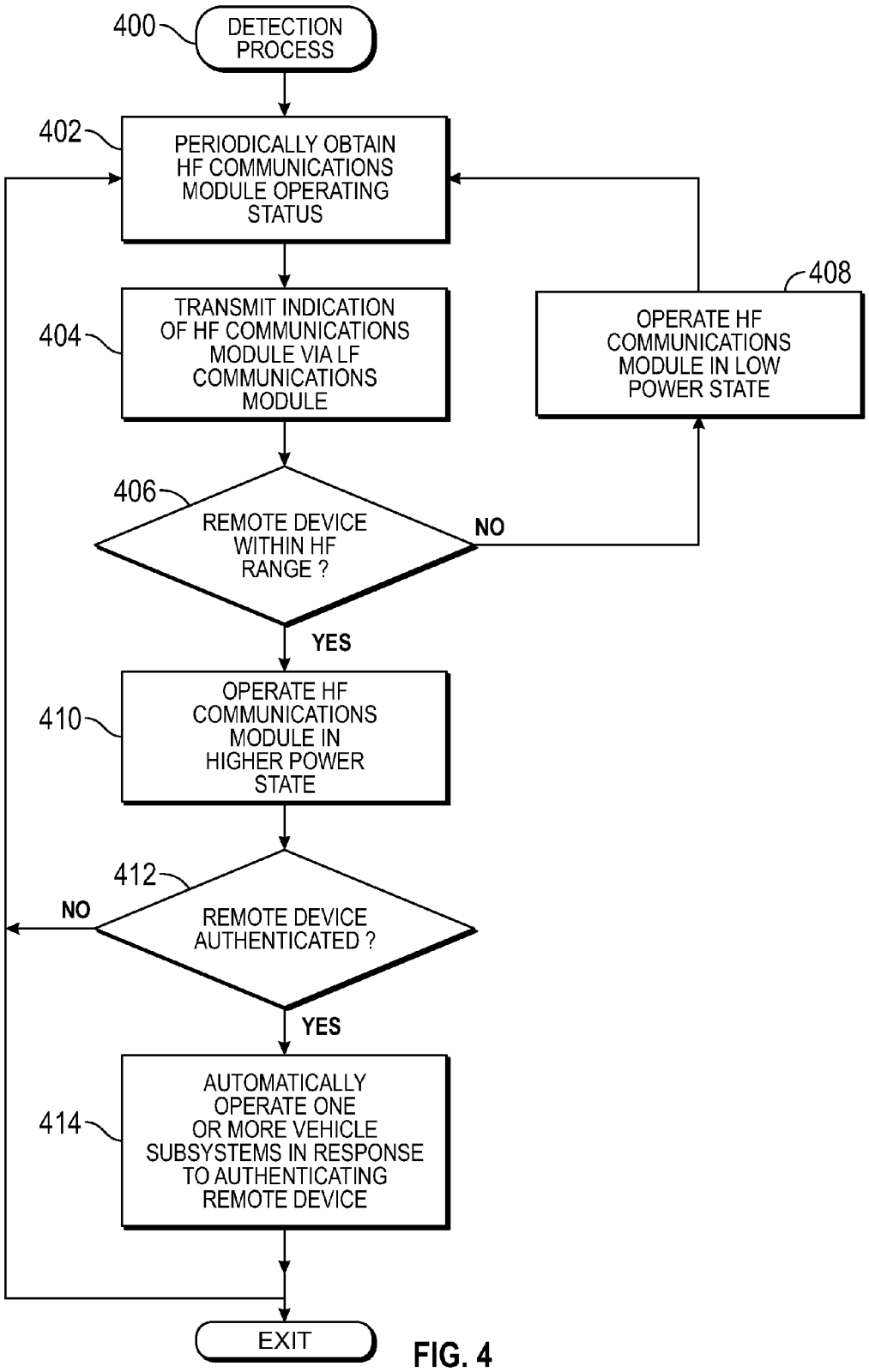
FIG. 4 is a flow diagram illustrating an exemplary detection process suitable for implementation by the vehicle in the communications system of FIG. 1 in accordance with an embodiment.

Still referring to FIG. 3, the one or more user input elements 310 are coupled to the control module 304 and configured to allow a user to operate the vehicle 102 via the fob 104 by manipulating the user input element(s) 310 when the fob 104 is within the communications range 106 of the vehicle higher frequency communications module 110. In this regard, depending on the embodiment, the user input element(s) 310 may include physical input elements (e.g., buttons, switches, and/or the like), virtual input elements (e.g., virtual buttons using touch-sensing and/or proximity-sensing technologies or the like), audio input elements (e.g., a microphone or the like), and/or any suitable combination thereof FIG. 4 depicts an exemplary embodiment of a detection process 400 for detecting or otherwise identifying presence of a remote device within a vicinity of a vehicle. In exemplary embodiments, the detection process 400 is performed by the vehicle 102 in the communications system 100 of FIG. 1 to detect or otherwise identify presence of the fob 104 within the communications range 106 of the vehicle higher frequency communications module 110. The various tasks performed in connection with the illustrated process 400 may be performed by hardware, suitably configured analog circuitry, software executed by processing circuitry, firmware executable by processing circuitry, or any combination thereof. For illustrative purposes, the following description may refer to elements mentioned above in connection with FIGS. 1-3. In practice, portions of the detection process 400 may be performed by different elements of the communications system 100, such as, for example, the control module 122, the vehicle higher frequency communications module 110, the vehicle lower frequency communications module 120, and/or one or more vehicle subsystems 202. It should be appreciated that practical embodiments of the detection process 400 may include any number of additional or alternative tasks, the tasks need not be performed in the illustrated order and/or the tasks may be performed concurrently, and/or the detection process 400 may be incorporated into a more comprehensive procedure or process having additional functionality not described in detail herein. Moreover, one or more of the tasks shown and described in the context of FIG. 4 could be omitted from a practical embodiment of the detection process 400 as long as the intended overall functionality remains intact.

The illustrated detection process 400 initializes or otherwise begins by periodically obtaining or otherwise identifying the current operating state (or operating mode) for the vehicle higher frequency communications module at 402 and transmitting or otherwise broadcasting an indication of the current operating state of the vehicle higher frequency communications module via the vehicle lower frequency communications module at 404. In this regard, the control module 122 may periodically poll or otherwise monitor the vehicle higher frequency communications module 110 to assess or otherwise determine its current operating state. In accordance with one or more embodiments, the vehicle higher frequency communications module 110 communicates a flag or some other output bit that indicates its current operating state whenever it is in an active or on state, wherein the control module 122 periodically accesses the operating state flag bit to identify the current operating state. In this regard, control module 122 determines the higher frequency communications module 110 is in an idle, sleep, or off state in response to the absence of the status flag for more than a threshold period of time. For example, the vehicle higher frequency communications module 110 may assert a logic high signal (e.g., logic '1') as the operating state flag bit when the vehicle higher frequency communications module 110 is in a higher power operating state and leave the output unasserted (e.g., logic '0') when the vehicle higher frequency communications module 110 is in a lower power operating state. In another embodiment, communications module 110 and control module 122 are coupled or otherwise connected with an in-vehicle communication network such as a Controller Area Network (CAN) or Local Interconnect Network (LIN), and operating state commands and status may be signals communicated within the network.

After obtaining the current status of the vehicle higher frequency communications module 110, the control module 122 generates a query message for transmission via the lower frequency communications module 120, wherein the query message indicates the current operating state of the higher frequency communications module 110. In exemplary embodiments, the query message generated by the control module 122 also includes the unique identifier associated with the vehicle 102 along with a value that may be utilized to authenticate responses to the query message. For example, the control module 122 may include a random number generator or the like that generates an acknowledgment value that may be included in the query message. In addition to and/or in conjunction with the unique identifier associated with the vehicle 102, the query message may include a pattern or sequence of bits configured to wake up, enable, or otherwise activate the fob 104, as described in greater detail below. After generating the query message, the control module 122 operates the vehicle lower frequency communications module 120 to transmit or otherwise broadcast the status message via a lower frequency communication channel. For example, the control module 122 may activate, enable, or otherwise turn on the vehicle lower frequency communications module 120 for a duration of time required to transmit the status message before reverting the vehicle lower frequency communications module 120 to a lower power state (e.g., an idle mode, a sleep mode, or the like) during which the vehicle lower frequency communications module 120 does not consume power from the energy source 108.

In exemplary embodiments, the detection process 400 continues by determining or otherwise identifying whether or not the associated remote device is within communications range of the vehicle higher frequency communications module at block 406 and operates the vehicle higher frequency communications module in a lower power state at block 408 when the remote device is not within communications range of the vehicle higher frequency communications module. In the lower power state (e.g., an idle operating mode, a sleep mode, or the like) the vehicle higher frequency communications module 110 periodically consumes power from the energy source 108 to periodically activate and listen for acknowledgment messages from the fob 104 before reverting to an inactive state where the vehicle higher frequency communications module 110 does not consume as much power from the energy source 108 for the remaining duration of the periodic interval. As described below, when the fob 104 receives a status message transmitted via the vehicle lower frequency communications module 120, the fob 104 automatically transmits an acknowledgment message via its higher frequency communications module 306 that is capable of being received by the vehicle higher frequency communications module 110.

In the absence of receiving the response to the status message from the fob 104, the vehicle higher frequency communications module 110 may automatically be operated in the lower power operating state. For example, in some embodiments, the vehicle higher frequency communications module 110 may implement a timer or some other equivalent feature so that if more than a specified time period has elapsed since the most recent acknowledgment message while the higher frequency communications module 110 is in an active operating mode where power from the energy source 108 is continuously consumed, the higher frequency communications module 110 may automatically transition from the active operating mode to an idle operating mode where power from the energy source 108 is periodically consumed. In other embodiments, the control module 122 may signal, command, or otherwise operate the vehicle higher frequency communications module 110 in the lower power state. For example, in the absence of an acknowledgment message, the control module 122 may automatically signal, command or otherwise operate the vehicle higher frequency communications module 110 to transition the vehicle higher frequency communications module 110 from the higher power operating state to the lower power operating state. In exemplary embodiments, the loop defined by 402, 404, 406 and 408 repeats so that the current operating status of the vehicle higher frequency communications module 110 is periodically obtained, the vehicle lower frequency communications module 120 is periodically activated to periodically transmit the indication of the current operating status of the vehicle higher frequency communications module 110, and the vehicle higher frequency communications module 110 is maintained in a lower power operating state while the fob 104 is not within communications range 106.

In response to determining or otherwise identifying that associated remote device is within communications range of the vehicle higher frequency communications module at block 406, the detection process 400 continues by operating the vehicle higher frequency communications module in a higher power state at block 410. In this regard, when the vehicle higher frequency communications module 110 is in the lower power state and receives a response to the indication previously transmitted via the vehicle lower frequency communications module 120, the vehicle higher frequency communications module 110 is automatically transitioned from the lower power operating state to a higher power operating state where the vehicle higher frequency communications module 110 continuously monitors the higher frequency communication channel for command signals from the fob 104. For example, as described in greater detail below, an acknowledgment message responsive to the indication may include a header portion having a duration greater than the periodic polling period of the vehicle higher frequency communications module 110 to ensure that the vehicle higher frequency communications module 110 receives or otherwise detects the acknowledgment message. In response, the vehicle higher frequency communications module 110 automatically transitions to an active operating mode to support receiving the entirety of the acknowledgment message transmitted by the fob 104 along with any other subsequent command signals that may be transmitted by the fob 104 while the fob 104 is within range 106.

In the illustrated embodiment, the detection process 400 continues by authenticating or otherwise verifying that the source of the response is a remote device associated with the vehicle at 412 and automatically initiates operation of one or more vehicle subsystems in response to authenticating the remote device at 414. In exemplary embodiments, the acknowledgment message received by the vehicle higher frequency communications module 110 is provided to the control module 122, which, in turn, parses or otherwise analyzes the content of the acknowledgment message to confirm the source of the acknowledgment message is the fob 104 that is paired or otherwise associated with the vehicle 102. As described in greater detail below in the context of FIGS. 5-8, in exemplary embodiments, the acknowledgment message transmitted by the fob 104 via its higher frequency communications module 306 in response to the status message received via its lower frequency communications module 308 includes the unique fob identification number associated with the fob 104 to indicate the fob 104 is the source of the acknowledgment message along with the acknowledgment value from the received status message. The control module 122 compares the fob identification number and the acknowledgment value from the received acknowledgment message to the stored fob identification number and the transmitted acknowledgment value to confirm that the received fob identification number matches the fob identification number for the fob 104 and that the received acknowledgment value matches the acknowledgment value from the status message.

When the received fob identification number matches the fob identification number from the status message and the received acknowledgment value matches the acknowledgment value from the status message, the control module 122 authenticates the response as being from the fob 104 paired with the vehicle 102. In accordance with one or more embodiments, the control module 122 automatically operates one or more vehicle subsystems 202 in response to detecting the fob 104 within the vicinity of the vehicle 102. In such embodiments, in response to authenticating a received acknowledgment message as being from the fob 104 associated with the vehicle 102, the control module 122 may automatically initiate operation of one or more vehicle subsystems 202, for example, by generating and providing the appropriate commands or signals to those vehicle subsystems 202. For example, if a passive lighting feature is enabled on the vehicle 102, the control module 122 may automatically command the lighting system 202 to activate or otherwise turn on one or more of the headlights, taillights, parking lights, brake lights, directional indicators, or the like.

Additionally, the control module 122 may operate one or more vehicle subsystems 202 in response to receiving user-initiated commands from the fob 104 while the fob 104 is within range 106 of the vehicle 102. For example, a user may manipulate a user input element 310 to open one or more doors 160 of the vehicle 102, wherein in response to the user manipulating the user input element 310, the control module 304 automatically generates corresponding door-opening commands and operates the higher frequency communications module 306 to transmit or otherwise communicate the door-opening commands to the vehicle 102. By virtue of the vehicle higher frequency communications module 110 being in the active operating mode once the fob 104 is within range 106 of the vehicle 102, the door-opening commands are received by the vehicle higher frequency communications module 110 and provided to the control module 122, which, in turn, may automatically operate the entry system 202 of the vehicle 102 accordingly to initiate the action commanded by the user operating the fob 104 in response to receiving the command.

In exemplary embodiments, the loop defined by 402, 404, 406, 408, 410 and 412 repeats so that the current operating status of the vehicle higher frequency communications module 110 is periodically obtained and the vehicle lower frequency communications module 120 is periodically activated to periodically transmit the indication of the current operating status of the vehicle higher frequency communications module 110. In this regard, as described in greater detail below, in response to receiving a status message indicating the vehicle higher frequency communications module 110 is in the higher power operating state, the fob 104 automatically transmits a response or acknowledgment message via its higher frequency communications module 306 that maintains the vehicle higher frequency communications module 110 in the higher power operating state throughout the duration of time the fob 104 is within the range 106 of the vehicle 102. Once the fob 104 is outside the range 106 of the vehicle 102, the fob 104 does not receive the status messages transmitted by the vehicle lower frequency communications module 120, and therefore, does not transmit acknowledgment messages to the vehicle 102. In response to an absence of a response to the indication of the operating state of the vehicle higher frequency communications module 110, the vehicle higher frequency communications module 110 and/or the control module 122 automatically transition the vehicle higher frequency communications module 110 from the higher power operating state to the lower power operating state to conserve power once the fob 104 is outside the communications range 106.

Figure 5:
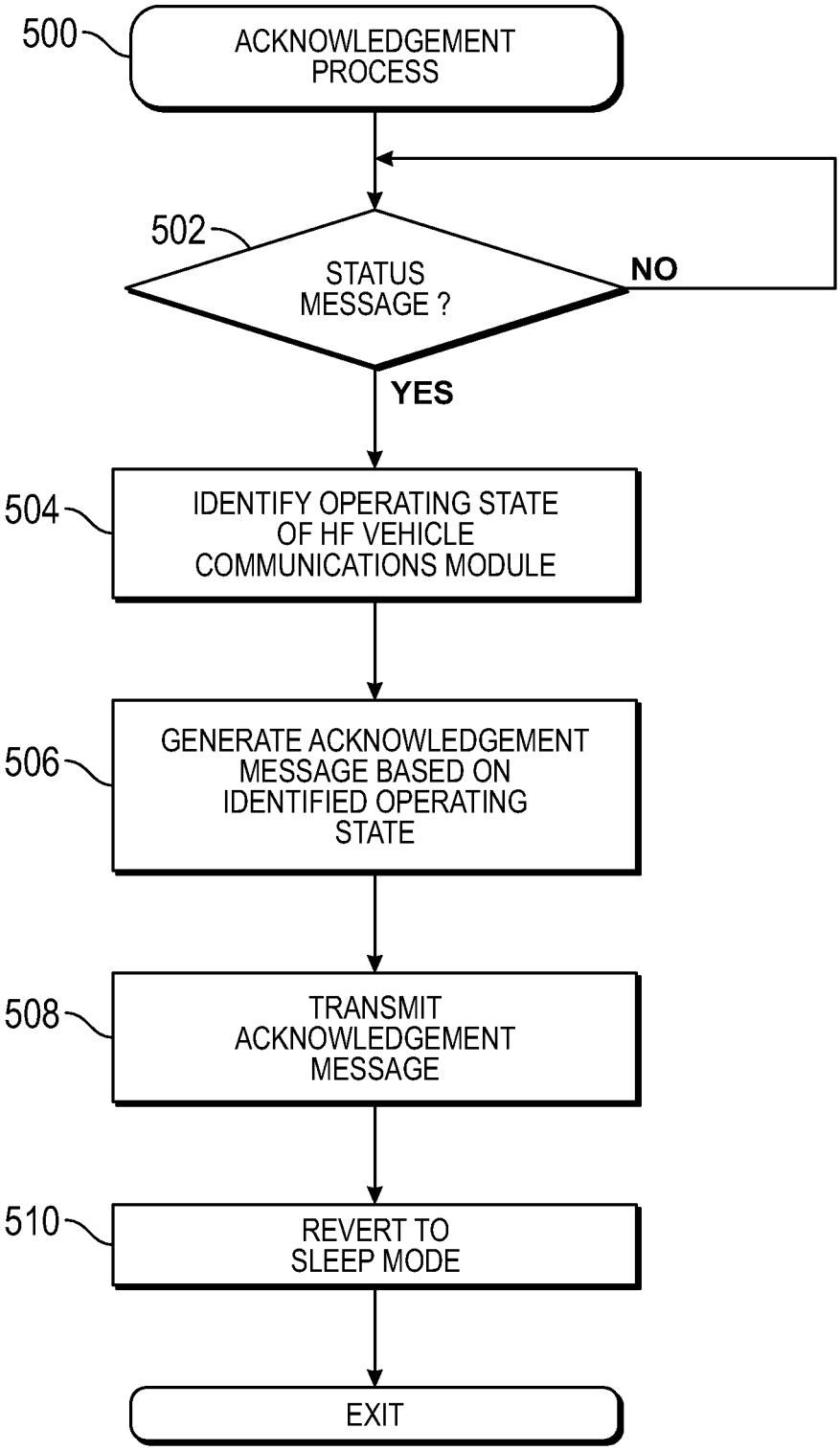
FIG. 5 is a flow diagram illustrating an exemplary acknowledgment process suitable for implementation by the remote device in the communications system of FIG. 1 in conjunction with the detection process of FIG. 4 in accordance with an embodiment.

FIG. 5 depicts an exemplary embodiment of an acknowledgment process 500 suitable for implementation by a remote device, such as fob 104, in conjunction with the detection process 400 of FIG. 4 to support detecting or otherwise identifying presence of the remote device within a vicinity of a vehicle. The various tasks performed in connection with the illustrated process 500 may be performed by hardware, suitably configured analog circuitry, software executed by processing circuitry, firmware executable by processing circuitry, or any combination thereof. For illustrative purposes, the following description may refer to elements mentioned above in connection with FIGS. 1-3. In practice, portions of the acknowledgment process 500 may be performed by different elements of the fob 104, such as, for example, the control module 304, the higher frequency communications module 306, and/or the lower frequency communications module 308. It should be appreciated that practical embodiments of the acknowledgment process 500 may include any number of additional or alternative tasks, the tasks need not be performed in the illustrated order and/or the tasks may be performed concurrently, and/or the acknowledgment process 500 may be incorporated into a more comprehensive procedure or process having additional functionality not described in detail herein. Moreover, one or more of the tasks shown and described in the context of FIG. 5 could be omitted from a practical embodiment of the acknowledgment process 500 as long as the intended overall functionality remains intact.

In exemplary embodiments, the acknowledgment process 500 identifies, detects or otherwise determines whether a message configured to activate or otherwise wakeup the remote device has been received via the lower frequency communications module of the remote device at 502. In this regard, in exemplary embodiments, the control module 304 and the fob higher frequency communications module 306 are both operated in a lower power operating mode (e.g., a sleep mode, an idle mode, or the like) to conserve power consumed from the energy source 302 in the absence of receiving messages from the vehicle 102 via the fob lower frequency communications module 308 that identify fob 104. When the fob 104 is within the communications range of the vehicle lower frequency communications module 120, the fob lower frequency communications module 308 receives the periodic query messages transmitted by the vehicle 102 that include the unique identifier for the vehicle 102 associated with the fob 104 and/or a pattern or sequence of bits configured to wake up, enable, or otherwise activate the fob 104. In response to receiving the status message including the unique vehicle identification number and/or the wakeup pattern, the control module 304 transitions from the lower power operating mode to a higher power operating mode (e.g., an active mode) and signals, commands or otherwise operates the fob higher frequency communications module 306 to transition the fob higher frequency communications module 306 from the lower power operating state to a higher power operating state.

After receiving a message configured to activate or otherwise enable the higher frequency communications of the remote device at 502, the acknowledgment process 500 continues by identifying or otherwise determining the operating status of the vehicle higher frequency communications module at 504, generating or otherwise creating an acknowledgment message based on the identified operating status at 506, and transmitting or otherwise broadcasting the acknowledgment message to the vehicle via the higher frequency communication channel at 508. The control module 304 parses or otherwise analyzes the status message received from the vehicle 102 to identify the operating state of the vehicle higher frequency communications module 110, and based on the indicated operating state, constructs an acknowledgment message having a length that is dependent on the indicated operating status for the vehicle higher frequency communications module 110. In this regard, when the status message indicates the vehicle higher frequency communications module 110 in a lower power state, the control module 304 and/or fob 104 generates a long acknowledgment message having a duration of transmission that is greater than the duration between the periodic polling by the vehicle higher frequency communications module 110 in the low power state. For example, if the vehicle higher frequency communications module 110 periodically polls for an acknowledgment message every forty milliseconds in an idle mode, the control module 304 and/or fob 104 generates a long acknowledgment message having a header (or preamble) portion including a number of bits such that a transmission duration for the header portion is greater than forty milliseconds, thereby ensuring that the vehicle higher frequency communications module 110 will detect the acknowledgment message while in the idle mode. Conversely, when the status message indicates the vehicle higher frequency communications module 110 in a higher power state, the control module 304 and/or fob 104 generates a short acknowledgment message having a header portion that contains a reduced number of bits relative to the long acknowledgement message.

Figure 6:
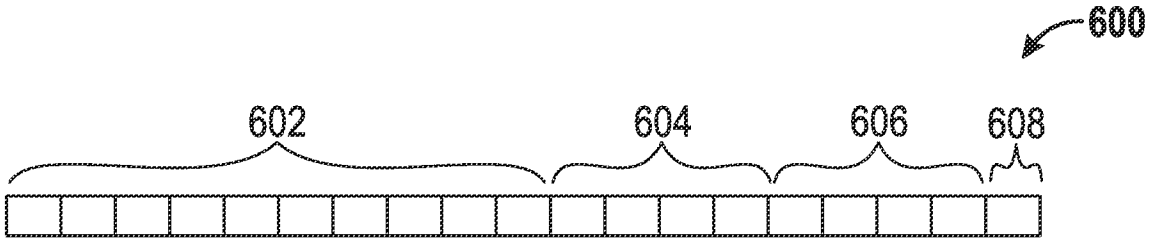
FIG. 6 depicts one exemplary embodiment of a long acknowledgment message suitable for transmission by the remote device in conjunction with the acknowledgment process of FIG. 5.
Figure 7:
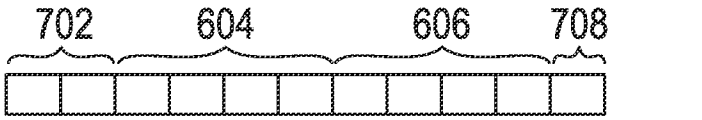
FIG. 7 depicts one exemplary embodiment of a short acknowledgment message suitable for transmission by the remote device in conjunction with the acknowledgment process of FIG. 5.

For example, referring now to FIG. 6, in accordance with one embodiment, a long acknowledgment message 600 generated and transmitted by the control module 304 and/or fob 104 includes a header portion 602 comprised of ten bytes, followed by an acknowledgment portion 604 comprised of four bytes, an identification portion 606 comprised of four bytes, and a checksum portion 608 comprised of a single byte. In this regard, the header portion 602 consists of dummy values (e.g., alternating ones and zeros) that are intended to trigger or otherwise initiate transitioning of the vehicle higher frequency communications module 110 to a higher power state. In the illustrated embodiment, the acknowledgment portion 604 consists of the acknowledgment value from the status message that was transmitted by the vehicle 102 and the identification portion 606 consists of the unique identification value associated with the fob 104. Conversely, as illustrated in FIG. 7, in accordance with one embodiment, a short acknowledgment message 700 generated and transmitted by the control module 304 and/or fob 104 includes a header portion 702 comprised of two bytes, followed by the same acknowledgment portion 604 and the identification portion 606 that would otherwise be transmitted in the long acknowledgment message 600 if the status message indicated that the vehicle higher frequency communications module 110 were in a lower power state, and a checksum portion 708 comprised of a single byte. In this regard, by virtue of the reduced header portion 702 in the short acknowledgment message 700, the amount of power from the energy source 302 consumed by the control module 304 and/or higher frequency communications module 306 for transmitting the short acknowledgment message 700 is reduced relative to the power consumed to transmit the long acknowledgment message 600.

Referring again to FIG. 5, after the control module 304 generates or otherwise constructs the appropriate acknowledgment message for the identified operating status of the vehicle higher frequency communications module 110, the control module 304 signals, commands, or otherwise operates the fob higher frequency communications module 306 to transmit or otherwise broadcast the acknowledgment message via a higher frequency communication channel. As described above, in one or more exemplary embodiments, in response to receiving or otherwise detecting the acknowledgment message via the higher frequency communication channel, the control module 122 parses or otherwise analyzes the acknowledgment and identification portions 604, 606 of the acknowledgment message to authenticate or otherwise verify the acknowledgment message as being transmitted from an associated fob 104 before automatically initiating operation of one or more vehicle subsystems 202.

After transmitting the acknowledgment message, the illustrated acknowledgment process 500 continues with the remote device automatically transitioning or otherwise reverting back to a lower power operating state at 510. In exemplary embodiments, after operating the higher frequency communications module 306 to transmit the acknowledgment message, the control module 304 and the higher frequency communications module 306 automatically transition back from an active mode to an idle or sleep mode to conserve power consumed from the energy source 302. In this manner, when the fob 104 leaves or otherwise exits the communications range 106 of the vehicle 102, the control module 304 and the higher frequency communications module 306 may automatically operate in a lower power mode by default. In practice, the acknowledgment process 500 repeats indefinitely in response to the fob 104 detecting or otherwise receiving messages via its lower frequency communications module 308 to receive and acknowledge any messages transmitted by its associated vehicle 102.

Figure 8:
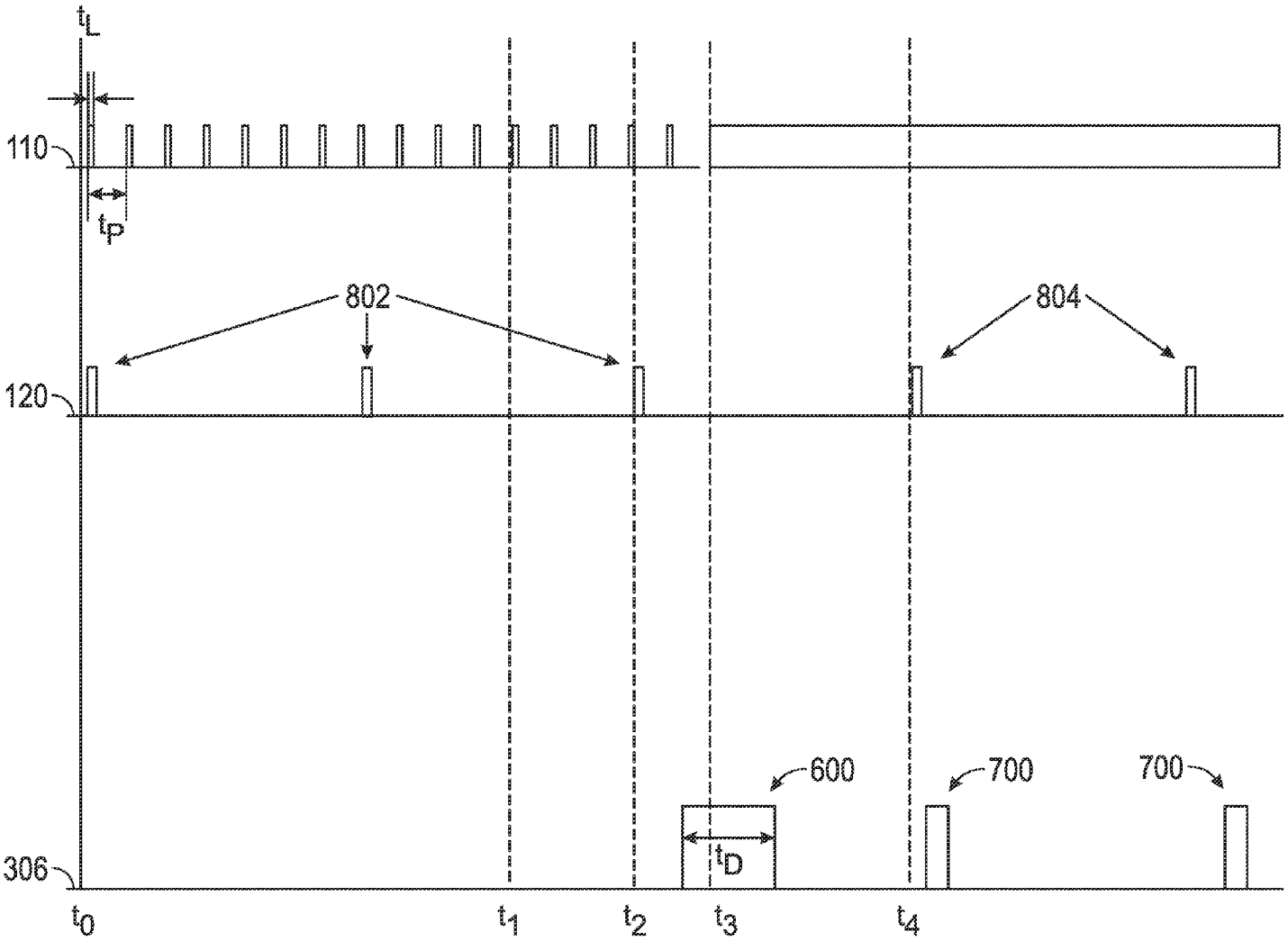
FIG. 8 depicts a timing diagram illustrating communications within the communications system of FIG. 1 in accordance with one exemplary embodiment of the detection process of FIG. 4 in conjunction with the acknowledgment process of FIG. 5 and the acknowledgment messages of FIGS. 6-7.

FIG. 8 depicts an exemplary timing diagram 800 illustrating the detection process 400 in conjunction with the acknowledgment process 500 of FIG. 5 and the acknowledgment messages 600, 700 of FIGS. 6-7. In the illustrated embodiment, at some initial time ($t_0$), the fob 104 is not within the communications range 106 of the vehicle 102. The vehicle higher frequency communications module 110 operates in an idle mode, a sleep mode, or some other lower power operating mode by periodically polling or otherwise listening for communications on a higher frequency communication channel for a percentage of a polling period ($t_P$) before reverting to an idle state for a remainder of the polling period ($t_P$). For example, the polling period may be forty milliseconds (e.g., ($t_P$=0.040 seconds) with the duration of time for which the vehicle higher frequency communications module 110 polls or listens for communications being equal to two milliseconds (e.g., $t_L$=0.002 seconds). The control module 122 identifies or otherwise determines the current operating state of the vehicle higher frequency communications module 110 as a lower power state and periodically transmits or otherwise broadcasts status messages 802 via the vehicle lower frequency communications module 120 that indicate the vehicle higher frequency communications module 110 is in a lower power operating state. It should be noted that the control module 122 and/or the vehicle lower frequency communications module 120 may operate asynchronously with respect to the vehicle higher frequency communications module 110, that is, the periodic status messages 802 may be temporally independent of the periodic polling by the vehicle higher frequency communications module 110.

In the illustrated example, at some subsequent time ($t_1$), the fob 104 enters the communications range 106 of the vehicle 102, so that the lower frequency communications module 308 of the fob 104 receives the periodic query message 802 transmitted via a lower frequency communication channel by the vehicle lower frequency communications module 120 at the beginning of the next status message transmission period at time ($t_2$). In response to detecting a query message 802 identifying the vehicle 102 associated with the fob 104 as the source of the query message 802, the control module 304 and the fob higher frequency communications module 306 transition from a lower power state to a higher power state. Based on the query message 802 indicating that the vehicle higher frequency communications module 110 is in a lower power operating state, the control module 304 generates a long acknowledgment message 600 and transmits the long acknowledgment message via the fob higher frequency communications module 306. As illustrated, the transmission duration ($t_D$) of the long acknowledgment message 600 is greater than the duration of the periodic polling period ($t_P$) for the vehicle higher frequency communications module 110 in the lower power operating state, such that the vehicle higher frequency communications module 110 detects the long acknowledgment message 600 at the beginning of the next polling period at time ($t_3$) and transitions to a higher power operating state.

At the beginning of the next query message transmission period at time ($t_4$), the control module 122 identifies or otherwise determines the current operating state of the vehicle higher frequency communications module 110 as the higher power operating state and transmits a query message 804 via the vehicle lower frequency communications module 120 that indicates the vehicle higher frequency communications module 110 is in the higher power operating state. In response, to a query message 804 identifying the higher frequency communications module 110 of the associated vehicle 102 is in the higher power operating state, the control module 304 generates a short acknowledgment message 700 and transmits the long acknowledgment message via the fob higher frequency communications module 306. In response to the short acknowledgment message 700, the higher frequency communications module 110 is maintained in the higher power operating state throughout the duration of time the fob 104 is within communications range 106 of the vehicle 102 to ensure any user-initiated commands (e.g., via user input element 310) can be received by the higher frequency communications module 110. As described above, once the fob 104 is no longer within the communications range 106 of the vehicle and stops receiving the query messages 804, the fob 104 ceases transmitting acknowledgment messages, which, in turn, causes the higher power operation of the higher frequency communications module 110 to timeout such that the higher frequency communications module 110 reverts to the lower power operating state. In this manner, when an associated fob 104 is within communications range 106 of the vehicle 102, the vehicle higher frequency communications module 110 is operated in an active operating mode to facilitate receiving user-initiated commands from the fob 104. Conversely, when the associated fob 104 is not within communications range 106 of the vehicle 102, the vehicle higher frequency communications module 110 may be operated in an idle (or sleep) mode to conserve power. In one or more embodiments, the higher frequency communications module 110 may automatically transition to the lower power operating state when a threshold amount of time has elapsed since an acknowledgment message was last received (e.g., after 100 milliseconds have passed since the last acknowledgment message). In other embodiments, the higher frequency communications module 110 may automatically transition to the lower power operating state only when other criteria are satisfied (e.g., some activity by or with respect to one or more vehicle subsystems 202, the vehicle 102 or another component therein may prevent the higher frequency communications module 110 from transitioning to the lower power operating state until that activity has ceased).

One benefit of the subject matter described herein is that the power consumption for detecting the presence of a remote device in the vicinity of a vehicle may be reduced. Additionally, the higher frequency communications module in the vehicle may be packaged separately from the lower frequency communications module to improve performance of the higher frequency communications module by moving it away from potential sources of electromagnetic interference. The vehicle communications modules are also capable of operating asynchronously, thereby reducing complexity.

For the sake of brevity, conventional techniques related to radio frequency communications, signaling, and other functional aspects of the subject matter may not be described in detail herein. In addition, certain terminology may also be used herein for the purpose of reference only, and thus are not intended to be limiting. For example, the terms "first", "second" and other such numerical terms referring to structures do not imply a sequence or order unless clearly indicated by the context. Additionally, the foregoing description also refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although a schematic shown in the figures may depict direct electrical connections between circuit elements and/or terminals, alternative embodiments may employ intervening circuit elements and/or components while functioning in a substantially similar manner.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof. Accordingly, details of the exemplary embodiments or other limitations described above should not be read into the claims absent a clear intention to the contrary.

What is claimed is:

1. A method comprising:

transmitting an indication of an operating state of a first communications module in a vehicle by a second communications module in the vehicle via a second communication channel, the first communications module communicating via a first communications channel and the operating state corresponding to a first mode;

receiving, by the first communications module from a remote device via the first communication channel, a long acknowledgment message responsive to the indication and having a duration influenced by the operating state when the operating state corresponds to a lower power state;

transitioning the first communications module from the first mode to a second mode in response to receiving the acknowledgment, the first communications module continuously monitoring the first communication channel in the second mode;

transmitting, by the second communications module via the second communication channel, a second indication of the operating state of the first communications module corresponding to the second mode; and receiving, by the first communications module from the remote device via the first communication channel, a short acknowledgment message responsive to the second indication and having a second duration influenced by the operating state when the operating state corresponds to a higher power state, wherein the second duration is shorter than the duration.

2. The method of claim 1, further comprising periodically polling, by the first communications module, the first communication channel while the first communications module is in the first mode prior to receiving the long acknowledgment message.

3. The method of claim 1, wherein:

transmitting the indication comprises transmitting the indication of a lower power operating mode; and transitioning the first communications module comprises transitioning the first communications module from the lower power operating mode to a higher power operating mode.

4. The method of claim 1, wherein:

the first communications module periodically consumes power from an energy source onboard the vehicle in the first mode; and the first communications module continuously consumes power from the energy source in the second mode.

5. The method of claim 1, further comprising:

authenticating the remote device based on the long acknowledgment message; and initiating action by a subsystem of the vehicle in response to authenticating the remote device.

6. The method of claim 5, wherein:

transmitting the indication comprises transmitting a query message including the indication and an acknowledgment value; and authenticating the remote device comprises authenticating the remote device when the long acknowledgment message includes the acknowledgment value.

7. A vehicle comprising:

a first communications module configured to communicate via a first communication channel; and a second communications module configured to transmit an indication of a first operating state of the first communications module via a second communication channel, wherein the first communications module is configured to transition from the first operating state to a second operating state in response to receiving a long acknowledgment message responsive to the indication from a remote device via the first communication channel, the first communications module continuously monitoring the first communication channel in the second operating state, wherein:

a duration of the long acknowledgment message is influenced by the first operating state; and the first communications module is configured to receive a short acknowledgment message when the second operating state corresponds to a higher power state.

8. The vehicle of claim 7, wherein the first operating state comprises an idle mode and the second operating state comprises an active mode.

9. The vehicle of claim 7, wherein the first communications module operates asynchronously with respect to the second communications module.

10. The vehicle of claim 7, wherein the first communications module is disposed in a first portion of the vehicle and the second communications module is disposed in a second portion of the vehicle distal to the first portion.

11. The vehicle of claim 7, wherein the first communication channel comprises an ultra-high frequency (UHF) communication channel and the second communication channel comprises a low frequency (LF) communication channel.

12. The vehicle of claim 7, further comprising a control module coupled to the first communications module and the second communications module, wherein the control module is configured to obtain information indicative of the first operating state from the first communications module, generate a query message including the indication of the first operating state, and operate the second communications module to transmit the query message via the second communication channel.

13. The vehicle of claim 7, further comprising:

a vehicle subsystem; and a control module coupled to the first communications module and the vehicle subsystem to automatically initiate operation of the vehicle subsystem in response to authenticating the remote device based on the long acknowledgment message.

14. The vehicle of claim 13, wherein the control module is coupled to the second communications module and configured to:

obtain information indicative of the first operating state from the first communications module;

generate a query message including an acknowledgment value and the indication of the first operating state;

operate the second communications module to transmit the query message via the second communication channel; and authenticate the remote device when the long acknowledgment message includes the acknowledgment value.

15. A system including the vehicle of claim 7 and the remote device, wherein the remote device comprises a key fob associated with the vehicle.

16. A remote device comprising:

a first communications module configured to receive, via a first communication channel, an indication of an operating state of a vehicle communications module, the vehicle communications module communicating via a second communication channel;

a second communications module configured to transmit a response to the indication via the second communication channel, wherein a duration of the response is influenced by the operating state; and a control module coupled to the first communications module and the second communications module to generate the response based on the indication of the operating state, wherein the control module is configured to:

generate a long acknowledgment message to be transmitted by the second communications module when the operating state corresponds to a lower power state; and generate a short acknowledgment message to be transmitted by the second communications module when the operating state corresponds to a higher power state.

17. The remote device of claim 16, wherein the first communication channel comprises a low frequency (LF) communication channel and the second communication channel comprises an ultra-high frequency (UHF) communication channel.

18. The remote device of claim 16, wherein the response comprises the long acknowledgment message including an acknowledgment value from the indication.

* * * * *